US008922326B2

(12) United States Patent
Inui et al.

(10) Patent No.: US 8,922,326 B2
(45) Date of Patent: Dec. 30, 2014

(54) LAMINATED ELECTRONIC COMPONENT AND METHOD OF MANUFACTURING LAMINATED ELECTRONIC COMPONENT

(71) Applicant: Murata Manufacturing Co., Ltd., Kyoto (JP)

(72) Inventors: Masaki Inui, Nagaokakyo (JP); Hiromu Fukushima, Nagaokakyo (JP)

(73) Assignee: Murata Manufactring Co., Ltd., Kyoto-fu (JP)

( * ) Notice: Subject to any disclaimer, the term of this patent is extended or adjusted under 35 U.S.C. 154(b) by 0 days.

(21) Appl. No.: 13/779,513

(22) Filed: Feb. 27, 2013

(65) Prior Publication Data

US 2013/0229253 A1 Sep. 5, 2013

(30) Foreign Application Priority Data

Mar. 2, 2012 (JP) ..... 2012-046538

(51) Int. Cl.

| | |
|---|---|
| ***H01F 27/28*** | (2006.01) |
| ***H01F 5/00*** | (2006.01) |
| ***H01F 7/06*** | (2006.01) |
| ***H01F 17/00*** | (2006.01) |
| ***H01F 41/02*** | (2006.01) |
| ***H01F 41/04*** | (2006.01) |

(52) U.S. Cl.

CPC ..... *H01F 17/0013* (2013.01); *H01F 41/0206* (2013.01); *H01F 17/0033* (2013.01); *H01F 41/046* (2013.01)

USPC ..... 336/233; 336/200; 336/234; 29/602.1

(58) Field of Classification Search

USPC ..... 336/83, 200, 223, 232, 234, 233; 29/602.1, 605; 156/272.4

See application file for complete search history.

(56) References Cited

U.S. PATENT DOCUMENTS

| | | | | |
|---|---|---|---|---|
| 5,396,101 | A * | 3/1995 | Shiga | 257/531 |
| 6,541,968 | B1 | 4/2003 | Tokuda | |
| 8,248,200 | B2 * | 8/2012 | Ishimoto et al. | 336/192 |
| 2003/0076211 | A1 * | 4/2003 | Matsuta et al. | 336/200 |
| 2003/0095026 | A1 * | 5/2003 | Kawanobe | 336/200 |
| 2006/0158301 | A1 * | 7/2006 | Shinkai et al. | 336/232 |
| 2011/0181384 | A1 * | 7/2011 | Inuduka et al. | 336/234 |
| 2012/0013421 | A1 * | 1/2012 | Hayata | 333/239 |
| 2012/0056705 | A1 * | 3/2012 | Kim et al. | 336/200 |

FOREIGN PATENT DOCUMENTS

| | | |
|---|---|---|
| JP | 07-032908 U | 6/1995 |
| JP | 2000-321341 A | 11/2000 |
| JP | 2005-116647 A | 4/2005 |
| JP | 2005-268455 A | 9/2005 |

* cited by examiner

*Primary Examiner* — Mangtin Lian
(74) *Attorney, Agent, or Firm* — Studebaker & Brackett PC

(57) ABSTRACT

A laminated electronic component includes a first magnetic material portion, a low-magnetic-permeability portion laminated on the first magnetic material portion, a second magnetic material portion laminated on the low-magnetic-permeability portion, at least one annular or spiral coil disposed within the low-magnetic-permeability portion, and a plurality of columnar magnetic material portions disposed within the low-magnetic-permeability portion so as to extend through inside of the coil and connecting the first magnetic material portion to the second magnetic material portion.

8 Claims, 7 Drawing Sheets

100

3
3a
3a
3a
3a
3a
7b
7c
2a
7d
7a
7b
2a
7c
4d
7d
8b
5b
7a
4c
7c
2a
2
2a
7d
7a
7b
6d
6b
2a
7c
7b
4b
7d
8a
5a
7a
4a
X
2a
7b
7c
7d
X
7a
1
1a
1a
1a
1a
1a
6a
6c

LAMINATED ELECTRONIC COMPONENT AND METHOD OF MANUFACTURING LAMINATED ELECTRONIC COMPONENT

CROSS REFERENCE TO RELATED APPLICATIONS

The present application claims priority to Japanese Patent Application No. 2012-046538 filed on Mar. 2, 2012, the entire contents of this application being incorporated herein by reference in its entirety.

TECHNICAL FIELD

The technical field relates to a laminated electronic component including a coil therein and a method of manufacturing the same.

BACKGROUND

In a conventional electronic component such as a common mode choke coil, a wire is generally wound on a core made of ferrite or the like. However, downsizing is a significant challenge also for coil components, and laminated electronic components which include a coil therein and are manufactured using ceramic lamination technology have widely been used in recent years. As an example of such a laminated electronic component, Patent Document 1 (Japanese Unexamined Patent Application Publication No. 2005-268455) discloses a common mode choke coil. FIG. 7 is an exploded perspective view showing the configuration of a conventional common mode choke coil 200.

The common mode choke coil 200 has a structure in which a low-magnetic-permeability portion 102 is laminated on a first magnetic material portion 101 and a second magnetic material portion 103 is laminated on the low-magnetic-permeability portion 102.

The first magnetic material portion 101 has a structure in which a plurality of magnetic material sheets 101*a* are laminated.

The low-magnetic-permeability portion 102 has a structure in which a plurality of low-magnetic-permeability sheets 102*a* are laminated and spiral coil conductors 104*a*, 104*b*, 104*c*, and 104*d* are each interposed between the two low-magnetic-permeability sheets 102*a* adjacent in the lamination direction. Each low-magnetic-permeability sheet 102*a* has a rectangular hole 102*b* extending therethrough in the lamination direction. In the magnetic material sheet 102*a*, the hole 102*b* is formed in a portion corresponding to the inside of the coil conductors 104*a* to 104*d*. In addition, predetermined sheets among the low-magnetic-permeability sheets 102*a* have via conductors 108*a* and 108*b* formed in predetermined portions for electrically connecting front and back sides.

Within the low-magnetic-permeability portion 102, the coil conductors 104*a* and 104*b* are connected to each other via the via conductor 108*a* to form a first coil 105*a*. In addition, the coil conductors 104*c* and 104*d* are connected to each other via the via conductor 108*b* to form a second coil 105*b*. Then, the first coil 105*a* and the second coil 105*b* are electromagnetically coupled to each other to constitute a common mode choke coil.

The second magnetic material portion 103 has a structure in which a plurality of magnetic material sheets 103*a* are laminated.

On the surface of the common mode choke coil 200, external electrodes 106*a*, 106*b*, 106*c*, and 106*d* are formed. The external electrode 106*a* is connected to an end of the coil conductor 104*a*, the external electrode 106*b* is connected to an end of the coil conductor 104*b*, the external electrode 106*c* is connected to an end of the coil conductor 104*c*, and the external electrode 106*d* is connected to an end of the coil conductor 104*d*.

The common mode choke coil 200 having such a structure is manufactured, for example, through the following processes. First, unfired magnetic material sheets 101*a*, unfired low-magnetic-permeability sheets 102*a*, and unfired magnetic material sheets 103*a* are prepared. Among them, in the low-magnetic-permeability sheets 102*a*, the holes 102*b*, the via conductors 108*a* and 108*b*, and the coil conductors 104*a* to 104*d* are previously formed. A predetermined number of such magnetic material sheets 101*a*, a predetermined number of such low-magnetic-permeability sheets 102*a*, and a predetermined number of such magnetic material sheets 103*a* are laminated in a predetermined order and then press-bonded. The laminate formed thus is fired at a predetermined profile. Then, the external electrodes 106*a* to 106*d* are formed on the surface of the fired laminate by burning a conductive paste. In the above manner, the common mode choke coil 200 is manufactured.

When the magnetic material sheets 101*a*, the low-magnetic-permeability sheets 102*a*, and the magnetic material sheets 103*a* are laminated and press-bonded to form the laminate, the magnetic material sheet 101*a* on the lower side and the magnetic material sheet 103*a* on the upper side enter the holes 102*b* formed in the low-magnetic-permeability sheets 102*a* due to the pressure. In addition, the magnetic material sheet 101*a* on the lower side and the magnetic material sheet 103*a* on the upper side are connected to each other within the holes 102*b*. In other words, the common mode choke coil 200 has a structure in which the first magnetic material portion 101 and the second magnetic material portion 103 are connected to each other by extending in a columnar manner through the low-magnetic-permeability portion 102 present therebetween and the coil conductors 104*a* to 104*d* are arranged around the columnar magnetic materials extending through the low-magnetic-permeability portion 102.

However, the common mode choke coil 200 disclosed in Patent Document 1 has a problem that when the amounts of the magnetic material sheet 101*a* on the lower side and the magnetic material sheet 103*a* on the upper side which enter the holes 102*b* of the low-magnetic-permeability sheets 102*a* are insufficient, both sheets are not connected to each other. In other words, the common mode choke coil 200 does not have a structure in which the first magnetic material portion 101 and the second magnetic material portion 103 are connected to each other by extending through the low-magnetic-permeability portion 102 present therebetween, and thus the common mode choke coil 200 becomes defective.

As a solution to this problem, a solution of previously filling a magnetic material into the holes 102*b* of the low-magnetic-permeability sheets 102*a* is conceivable. Such a solution is disclosed, for example, in Patent Document 2 (Japanese Unexamined Patent Application Publication No. 2000-321341). Specifically, a magnetic material is previously filled into holes formed in low-magnetic-permeability sheets (nonmagnetic material sheets). Then, a coil conductor (coil pattern) is inserted between the two low-magnetic-permeability sheets adjacent in a lamination direction. A plurality of lower magnetic material sheets, a plurality of the low-magnetic-permeability sheets between which the coil conductors have been interposed, and a plurality of upper magnetic material sheets are laminated and press-bonded. The laminate formed thus is fired. As a result, a coil is formed within the laminate.

For manufacturing the coil disclosed in Patent Document 2, for example, the following method may be used to fill the magnetic material into the holes formed in the low-magnetic-permeability sheets.

First, a plurality of retaining sheets to be processed are prepared.

Next, a low-magnetic-permeability slurry, namely, a material obtained by kneading a low-magnetic-permeability material, a binder, and a solvent, is applied onto each retaining sheet with a constant thickness, thereby forming a plurality of low-magnetic-permeability sheets.

Next, a frame-shaped blade is pressed against the low-magnetic-permeability sheet on each retaining sheet and separated therefrom. Then, only a low-magnetic-permeability sheet portion corresponding to inside of the blade is removed. By so doing, a hole is formed in each low-magnetic-permeability sheet. In addition, a hole for a via conductor is also formed in some of the low-magnetic-permeability sheets.

Next, a magnetic material slurry, namely, a material obtained by kneading a magnetic material, a binder, and a solvent, is filled into the hole formed in each low-magnetic-permeability sheet. Specifically, from one principal surface side of the low-magnetic-permeability sheet, the magnetic material slurry is applied to the hole formed in the low-magnetic-permeability sheet and the periphery of the hole, thereby filling the magnetic material slurry.

In addition, a conductive paste is filled into the above-described hole for a via conductor.

Next, coil conductors having a predetermined shape are formed on surfaces of predetermined sheets among a plurality of the low-magnetic-permeability sheets by printing a conductive paste. The coil conductors may be formed prior to forming the holes in the low-magnetic-permeability sheets.

At the end, the low-magnetic-permeability sheet in which the magnetic material has been filled is peeled off from each retaining sheet.

A coil manufactured by using the low-magnetic-permeability sheets obtained through such processes has a structure in which a first magnetic material portion and a second magnetic material portion are assuredly connected to each other via a columnar magnetic material formed so as to extend through a low-magnetic-permeability portion.

SUMMARY

The present disclosure provides a laminated electronic component which allows its productivity to be improved and a method of manufacturing the same.

In an aspect of the present disclosure, a laminated electronic component includes a first magnetic material portion, a low-magnetic-permeability portion laminated on the first magnetic material portion, a second magnetic material portion laminated on the low-magnetic-permeability portion, at least one annular or spiral coil disposed within the low-magnetic-permeability portion, and a plurality of columnar magnetic material portions disposed within the low-magnetic-permeability portion so as to extend through inside of the coil and connect the first magnetic material portion to the second magnetic material portion.

In another aspect of the present disclosure, a method of manufacturing a laminated electronic component includes the steps of preparing a plurality of magnetic material sheets; preparing a plurality of low-magnetic-permeability sheets; forming, in the low-magnetic-permeability sheets, a plurality of holes extending through the low-magnetic-permeability sheets; filling a magnetic material into the plurality of holes; forming an annular or spiral coil conductor on a surface of a predetermined sheet among the plurality of low-magnetic-permeability sheets; laminating a predetermined number of the magnetic material sheets to form a first magnetic material portion; laminating the plurality of low-magnetic-permeability sheets in which the magnetic material has been filled into the holes and the coil conductor has been formed on the surface of the predetermined sheet, on the first magnetic material portion in a predetermined order to form a low-magnetic-permeability portion; laminating a predetermined number of the magnetic material sheets on the low-magnetic-permeability portion to form a second magnetic material portion; and firing a laminate composed of the first magnetic material portion, the low-magnetic-permeability portion, and the second magnetic material portion.

DETAILED DESCRIPTION

The inventors realized that the manufacturing method disclosed in Patent Document 2 has a problem that in the process where the low-magnetic-permeability sheet in which the magnetic material has been filled in the hole is peeled off from each retaining sheet, if the opening area of the hole is large, the magnetic material comes off from the hole. In other words, the filled magnetic material remains on the surface of the retaining sheet, and the low-magnetic-permeability sheet in which the hole becomes hollow is peeled off from the retaining sheet. When the cross-sectional area of the hole formed in each low-magnetic-permeability sheet is larger, this problem prominently appears, and the frequency at which the magnetic material comes off from the hole is further increased. A non-defective coil cannot be manufactured by using such low-magnetic-permeability sheets. Thus, the conventional manufacturing method has a problem that high productivity cannot be obtained.

Hereinafter, an exemplary embodiment of the present disclosure that can address the above shortcomings will now be described with reference to the drawings.

Figure 1:
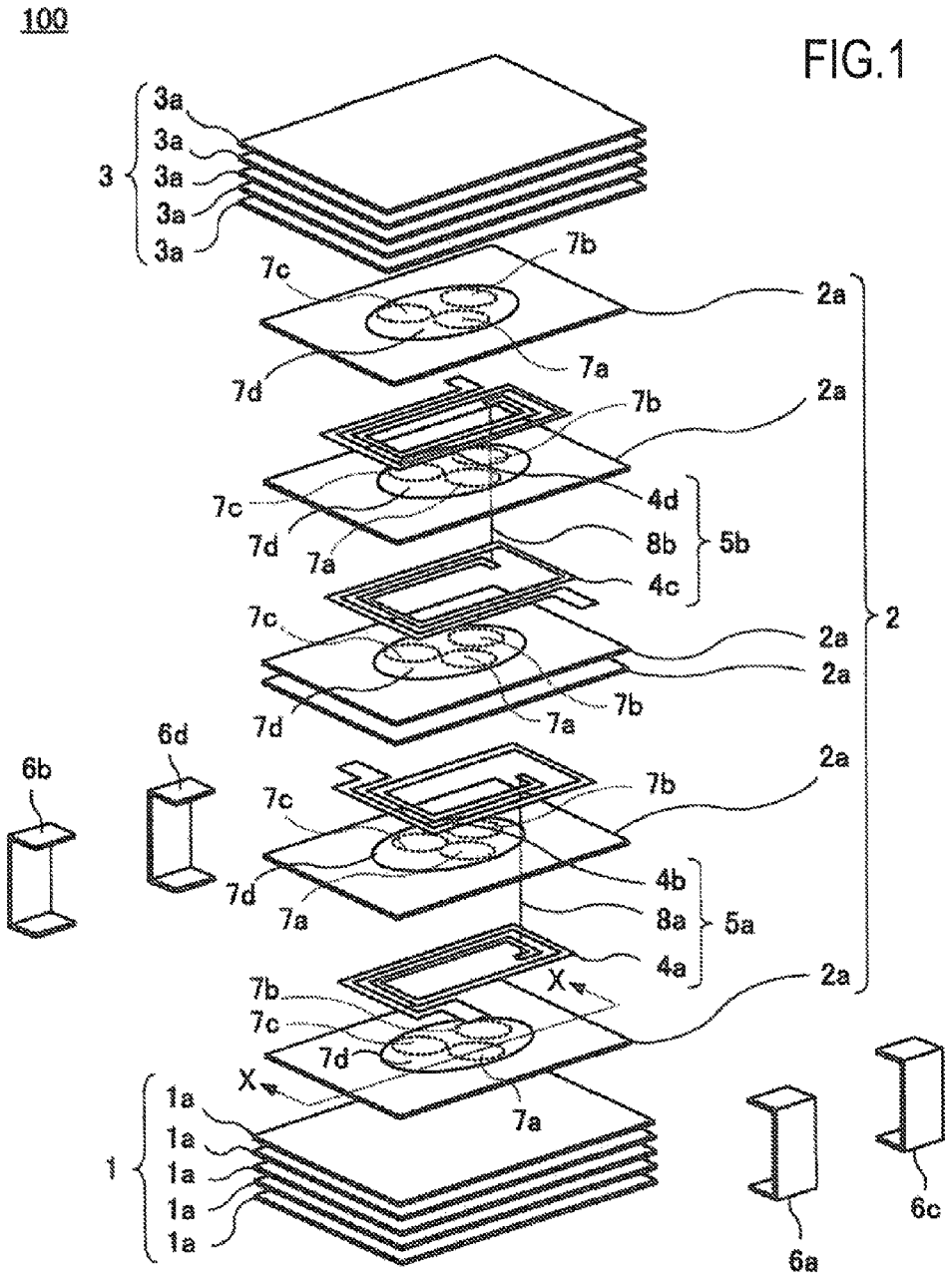
FIG. 1 is an exploded perspective view showing a common mode choke coil according to an exemplary embodiment.

FIG. 1 is an exploded perspective view of a common mode choke coil 100 according to the exemplary embodiment.

The common mode choke coil 100 has a structure in which a low-magnetic-permeability portion 2 is laminated on a first magnetic material portion 1 and a second magnetic material portion 3 is laminated on the low-magnetic-permeability portion 2. The low-magnetic-permeability portion 2 is formed from a material having a lower magnetic permeability than the first magnetic material portion 1, the second magnetic material portion 3, and further penetrating magnetic materials 7*a*, 7*b*, and 7*c* described later, but the material thereof may be a magnetic material or a nonmagnetic material. For example, for the low-magnetic-permeability portion 2, a magnetic material which has a lower magnetic permeability than the first magnetic material portion 1 but is of the same composition type as the first magnetic material portion 1 may be used.

The first magnetic material portion 1 has a structure in which a plurality of magnetic material sheets 1*a* are laminated. The common mode choke coil 100 according to the embodiment is formed by a laminate being integrally fired as described later, and thus the interfaces between the magnetic material sheets 1*a* may disappear within the first magnetic material portion 1. As the material of the first magnetic material portion 1, for example, Ni—Cu—Zn ferrite, Mn—Zn ferrite, hexagonal ferrite, and the like can be used.

The low-magnetic-permeability portion 2 has a structure in which a plurality of low-magnetic-permeability sheets 2*a* are laminated. Here, a spiral coil conductor may be interposed between the two low-magnetic-permeability sheets 2*a* adjacent in the lamination direction. In FIG. 1, spiral coil conductors 4*a* to 4*d* are interposed. Each low-magnetic-permeability sheet 2*a* has penetrating magnetic materials 7*a*, 7*b*, and 7*c* having circular transverse sections. The penetrating magnetic materials 7*a* to 7*c* extend through each low-magnetic-permeability sheet 2*a* in the lamination direction. The penetrating magnetic materials 7*a* to 7*c* are formed in a portion of a principal surface of the magnetic material sheet 2*a* which corresponds to the inside of the coil conductors 4*a* to 4*d*. In the embodiment, for convenience of a manufacturing method, the penetrating magnetic materials 7*a* to 7*c* are connected to each other by a film-shaped magnetic material 7*d* formed on the upper principal surface of each low-magnetic-permeability sheet 2*a*. In addition, in some of the low-magnetic-permeability sheets 2*a*, via conductors 8*a* and 8*b* are formed in predetermined portions for electrically connecting front and back sides.

A plurality of the low-magnetic-permeability sheets 2*a* are laminated, the penetrating magnetic materials 7*a* formed in the respective low-magnetic-permeability sheet 2*a* are laminated to form one columnar magnetic material portion, the penetrating magnetic materials 7*b* are laminated to form another columnar magnetic material portion, and the penetrating magnetic materials 7*c* are laminated to form still another columnar magnetic material portion. That is, three columnar magnetic material portions are formed in total.

As the material of the low-magnetic-permeability portion 2, for example, a nonmagnetic material such as glass ceramics having a magnetic permeability of about 1, Ni—Cu—Zn ferrite having a magnetic permeability of about 1 to 10, nonmagnetic ferrite, and the like can be used. In addition, as the penetrating magnetic materials 7*a*, 7*b*, and 7*c*, the same material as that of the first magnetic material portion 1 as described above can be used. Furthermore, as the material of the coil conductors 4*a* to 4*d* and the via conductors 8*a* and 8*b*, for example, a metal such as Cu, Pd, Al, and Ag or an alloy containing at least one of these metals can be used. The common mode choke coil 100 according to the embodiment is formed by a laminate being integrally fired as described later, and thus the interfaces between the low-magnetic-permeability sheets 2*a* or the interfaces between the penetrating magnetic materials 7*a*, between the penetrating magnetic materials 7*b*, or between the penetrating magnetic materials 7*c* may disappear within the low-magnetic-permeability portion 2.

Within the low-magnetic-permeability portion 2, the coil conductor 4*a* and the coil conductor 4*b* are connected to each other via the via conductor 8*a* to form a first coil 5*a*. In addition, the coil conductor 4*c* and the coil conductor 4*d* are connected to each other via the via conductor 8*b* to form a second coil 5*b*. The first coil 5*a* and the second coil 5*b* are electromagnetically coupled to each other to constitute a common mode choke coil. The second magnetic material portion 3 has a structure in which a plurality of magnetic material sheets 3*a* are laminated. As the material of the second magnetic material portion 3, the same material as that of the first magnetic material portion 1 can be used. The common mode choke coil 100 according to the embodiment is formed by a laminate being integrally fired as described later, and thus the interfaces between the magnetic material sheets 3*a* may disappear within the second magnetic material portion 3.

External electrodes 6*a*, 6*b*, 6*c*, and 6*d* are formed on the surface of the common mode choke coil 100. The external electrode 6*a* is connected to an end of the coil conductor 4*a*, the external electrode 6*b* is connected to an end of the coil conductor 4*b*, the external electrode 6*c* is connected to an end of the coil conductor 4*c*, and the external electrode 6*d* is connected to an end of the coil conductor 4*d*. As the material of the external electrodes 6*a*, 6*b*, 6*c*, and 6*d*, for example, a metal such as Cu, Pd, Al, and Ag or an alloy containing at least one of these metals can be used.

In the common mode choke coil 100 according to the embodiment, within the low-magnetic-permeability portion 2, the three columnar magnetic material portions, namely, the laminate of the penetrating magnetic materials 7*a*, the laminate of the penetrating magnetic materials 7*b*, and the laminate of the penetrating magnetic materials 7*c*, are formed, and they connect the first magnetic material portion 1 to the second magnetic material portion 3. The transverse section of each columnar magnetic material portion is small, but the sum of the cross-sectional areas of the three columnar magnetic material portions is equivalent to that in the related art. Therefore, electrical properties equivalent to those in the related art can be obtained.

Next, an example of a method of manufacturing the common mode choke coil 100 according to the embodiment will be described with reference to FIGS. 2A to 5B.

Figure 2A:
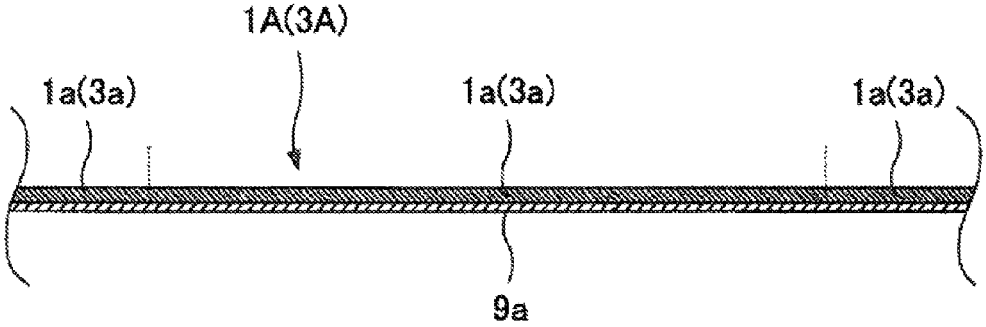
FIG. 2A is a cross-sectional view showing an initial process of a method of manufacturing the common mode choke coil in FIG. 1.

First, as shown in FIG. 2A, a retaining sheet 9*a*, which is formed from PET (polyethylene terephthalate) or the like and is to be processed, is prepared. A magnetic material slurry is applied onto the retaining sheet 9*a* with a predetermined thickness to produce a mother magnetic material sheet 1A (3A) in which a large number of magnetic material sheets 1*a* or 3*a* are arranged in a matrix manner. In FIG. 2A, the interfaces between the adjacent magnetic material sheets 1*a* (3*a*) of the mother magnetic material sheet 1A (3A) are indicated by chain lines. The magnetic material slurry is applied, for example, by a doctor blade method. A plurality of the mother magnetic material sheets 1A (3A) as described above are produced according to need.

Figure 2B:
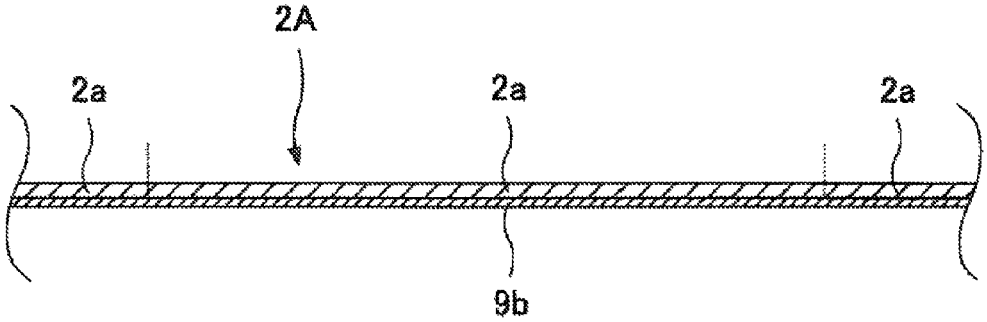
FIG. 2B is a cross-sectional view showing a process subsequent to FIG. 2A.

In addition, as shown in FIG. 2B, a retaining sheet 9*b*, which is formed from PET or the like and is to be processed, is prepared. A low-magnetic-permeability slurry is applied onto the retaining sheet 9*b* with a predetermined thickness to produce a mother low-magnetic-permeability sheet 2A in which a large number of low-magnetic-permeability sheets 2*a* are arranged in a matrix manner. In FIG. 2B, the interfaces between the adjacent low-magnetic-permeability sheets 2*a* of the mother low-magnetic-permeability sheet 2A are indicated by chain lines (the same applies to the following drawings). The low-magnetic-permeability slurry is applied, for example, by a doctor blade method. A plurality of the mother low-magnetic-permeability sheets 2A as described above are produced according to need.

Figure 2C:
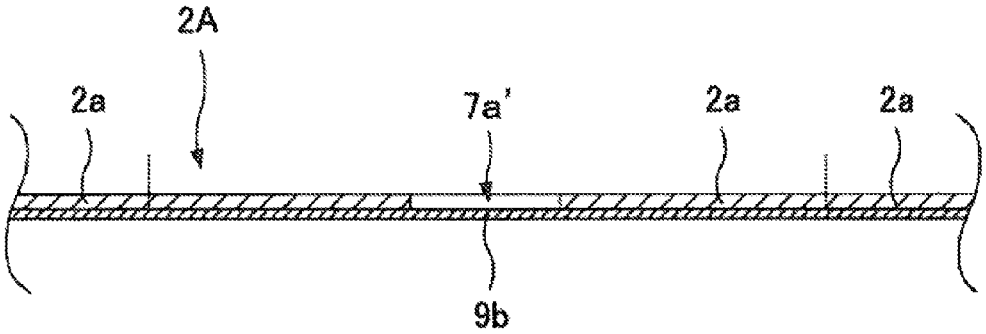
FIG. 2C is a cross-sectional view showing a process subsequent to FIG. 2B.

Next, as shown in FIG. 2C, three holes 7*a*' to 7*c*' for forming the penetrating magnetic materials 7*a* to 7*c* are formed in each low-magnetic-permeability sheet 2*a* of the mother low-magnetic-permeability sheet 2A. FIG. 2C shows a cross section corresponding to a portion of the low-magnetic-permeability sheet 2*a* taken along a broken-line arrow X-X in FIG. 1, and thus only the hole 7*a*' appears and the holes 7*b*' and 7*c*' do not appear in FIG. 2C. The holes 7*a*' to 7*c*' are formed, for example, by pressing an annular blade against each low-magnetic-permeability sheet 2*a* formed on the retaining sheet 9*b*, separating the blade therefrom, and removing a low-magnetic-permeability sheet portion corresponding to inside of the blade.

In addition, although not shown, a hole 8*a*' or 8*b*' for forming the via conductor 8*a* or 8*b* is formed in each low-magnetic-permeability sheet 2*a* formed in a portion of the mother low-magnetic-permeability sheet 2A. The hole 8*a*' or 8*b*' is formed, for example, by applying a laser beam.

Figure 3A:
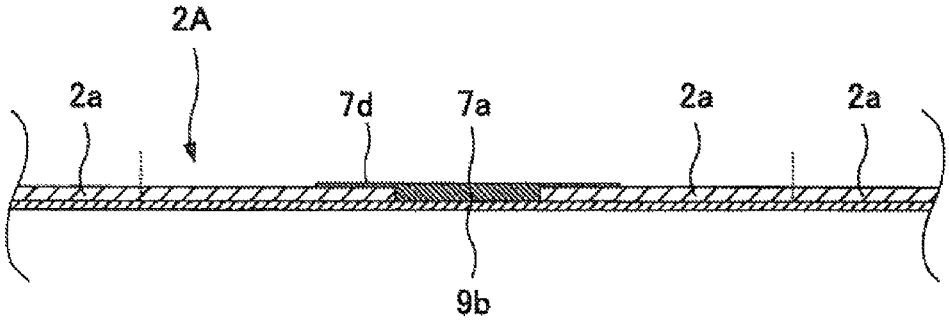
FIG. 3A is a cross-sectional view showing a process subsequent to FIG. 2C.

Next, as shown in FIG. 3A, the magnetic material slurry is filled into the three holes 7*a*' to 7*c*' formed in each low-magnetic-permeability sheet 2*a* of the mother low-magnetic-permeability sheet 2A, whereby the penetrating magnetic materials 7*a* to 7*c* are formed. The magnetic material slurry is filled, for example, by a screen printing method.

In the embodiment, at that time, the circular film-shaped magnetic material 7*d* is formed in a region on the upper principal surface of each low-magnetic-permeability sheet 2*a* which includes the holes 7*a*' to 7*c*'. The film-shaped magnetic material 7*d* is connected to each of the penetrating magnetic materials 7*a* to 7*c*. The film-shaped magnetic material 7*d* is not an essential component in the embodiment, and the magnetic material slurry may be supplied into only the holes 7*a*' to 7*c*'. FIG. 3A shows a cross section corresponding to the portion of the low-magnetic-permeability sheet 2*a* taken along the broken-line arrow X-X in FIG. 1, and thus only the penetrating magnetic material 7*a* appears and the penetrating magnetic materials 7*b* and 7*c* do not appear in FIG. 3A.

In addition, although not shown, a conductive paste is filled into the hole 8*a*' or 8*b*' formed in the portion of the mother low-magnetic-permeability sheet 2A, whereby the via conductor 8*a* or 8*b* is formed. The conductive paste is filled, for example, by a screen printing method.

Figure 3B:
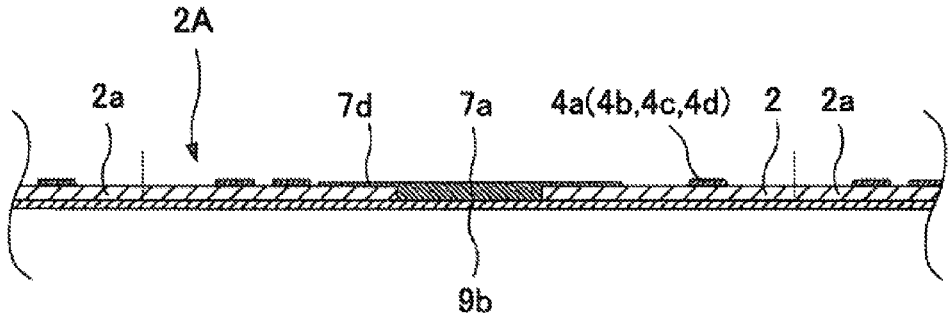
FIG. 3B is a cross-sectional view showing a process subsequent to FIG. 3A.

Next, as shown in FIG. 3B, any one of the coil conductors 4*a* to 4*d* is formed on each low-magnetic-permeability sheet 2*a* formed in the portion of the mother low-magnetic-permeability sheet 2A. The coil conductors 4*a* to 4*d* are formed, for example, by screen printing the conductive paste into a desired shape. The coil conductors 4*a* to 4*d* have shapes different from each other.

Next, although not shown, the mother magnetic material sheets 1A and 3A are peeled off from the retaining sheets 9*a*.

Figure 3C:
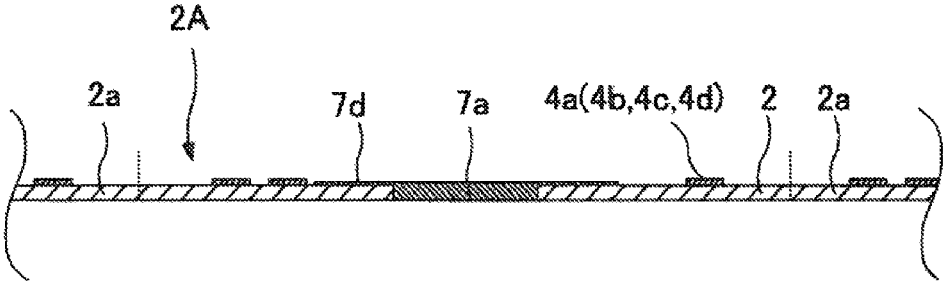
FIG. 3C is a cross-sectional view showing a process subsequent to FIG. 3B.
Figure 6A:
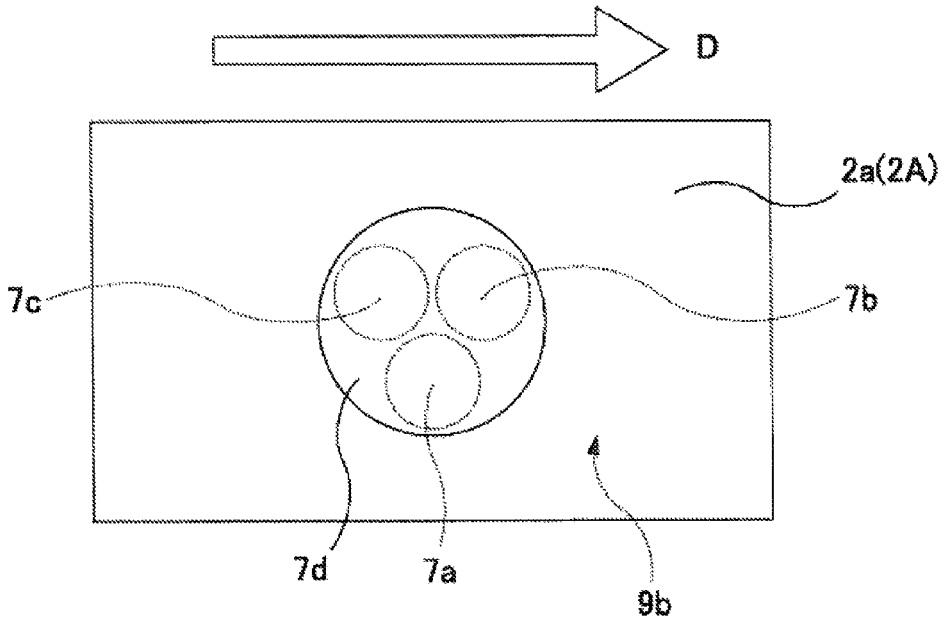
FIG. 6A is a plan view showing a process of peeling off a low-magnetic-permeability sheet from a retaining sheet in the method of manufacturing the common mode choke coil shown in FIG. 1.

In addition, as shown FIG. 3C, the mother low-magnetic-permeability sheet 2A is peeled off from the retaining sheet 9*b*. The process of peeling off the mother low-magnetic-permeability sheet 2A from the retaining sheet 9*b* will be separately described with reference to the plan view of FIG. 6A. FIG. 6A shows one low-magnetic-permeability sheet 2*a* in the mother low-magnetic-permeability sheet 2A, and thus a description will be given below with the low-magnetic-permeability sheet 2*a* as one unit.

As shown in FIG. 6A, when the low-magnetic-permeability sheet 2*a* is peeled off from the retaining sheet 9*b* in an arrow D direction, the penetrating magnetic material 7*c* initially starts being peeled off. Subsequently, while the penetrating magnetic material 7*c* is peeled off, the penetrating magnetic material 7*a* starts being peeled off. Subsequently, after the penetrating magnetic material 7*c* is completely peeled off and while the penetrating magnetic material 7*a* is peeled off, the penetrating magnetic material 7*b* starts being peeled off. As described above, the penetrating magnetic materials 7*a* to 7*c* are preferably peeled off in order at different timings. When a portion where the penetrating magnetic materials 7*a* to 7*c* are present (a portion where the holes are present) is peeled off, an unstable tensile force is applied to the low-magnetic-permeability sheet 2*a*. Thus, the low-magnetic-permeability sheet 2*a* is easily broken when the penetrating magnetic materials 7*a* to 7*c* are simultaneously peeled off. However, when the penetrating magnetic materials 7*a* to 7*c* are peeled off in order at different timings, breaking of the low-magnetic-permeability sheet 2*a* can be prevented.

Figure 6B:
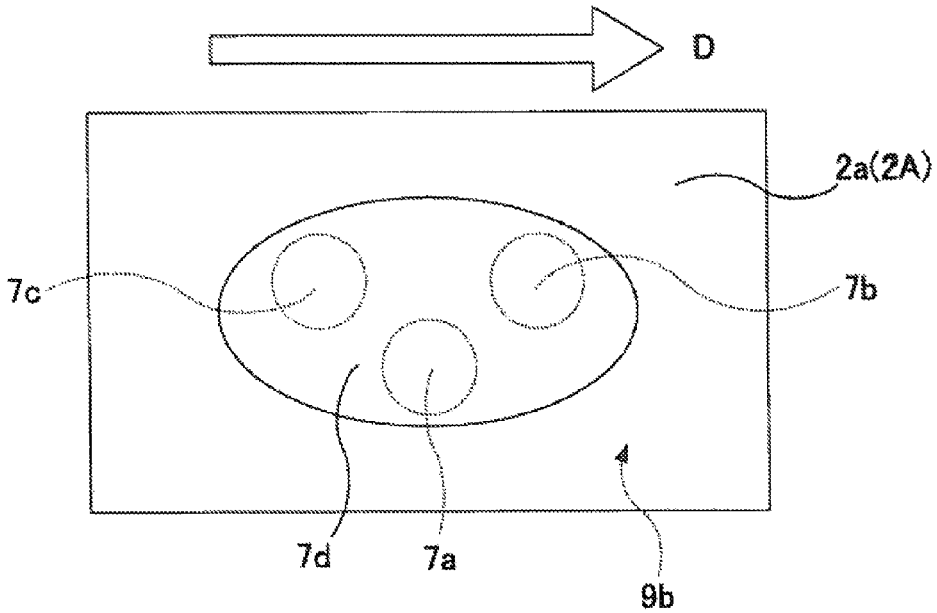
FIG. 6B is a plan view of a modification of FIG. 6A.
Figure 7:
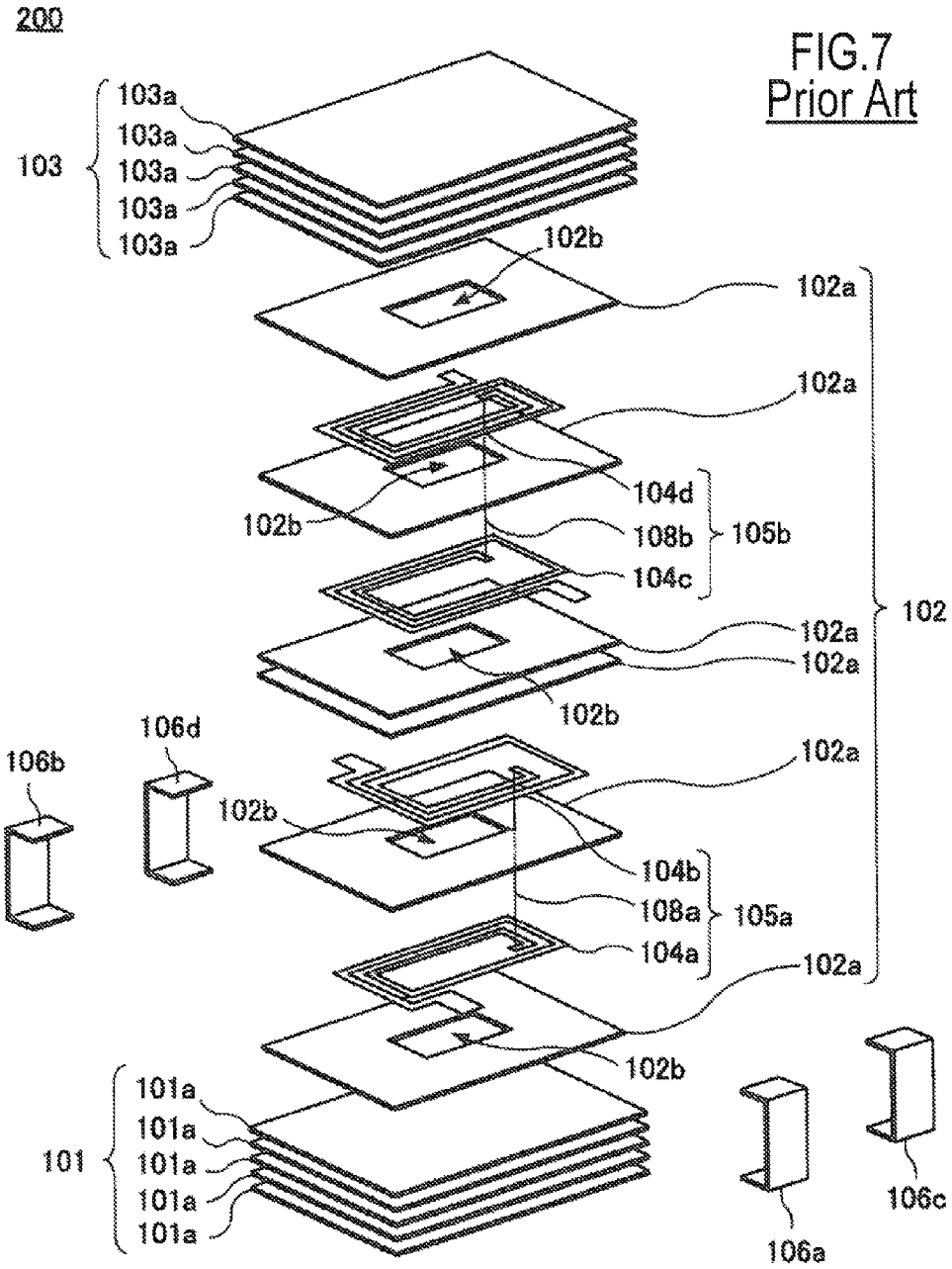
FIG.7 Prior Art
FIG. 7 is an exploded perspective view showing an existing common mode choke coil.

As shown in FIG. 6B, the formed positions of the penetrating magnetic materials 7*a* to 7*c* may be changed to positions different from those in the example of FIG. 6A. In the example of FIG. 6B, the penetrating magnetic materials 7*a* to 7*c* are formed such that the penetrating magnetic material 7*a* starts being peeled off after the penetrating magnetic material 7*c* is completely peeled off and the penetrating magnetic material 7*b* starts being peeled off after the penetrating magnetic material 7*a* is completely peeled off. With this configuration, the effect of preventing the low-magnetic-permeability sheet 2*a* from being broken is further enhanced.

As described above, although the low-magnetic-permeability sheet 2*a*, namely, the mother low-magnetic-permeability sheet 2A, is peeled off from the retaining sheet 9*b*, a columnar magnetic material portion formed within the low-magnetic-permeability portion 2 is divided into a plurality of portions and the transverse sectional area of each portion is small in the embodiment. Thus, the surface area of each of the penetrating magnetic materials 7*a* to 7*c* formed in the low-magnetic-permeability sheet 2*a* is also small, and hence when the low-magnetic-permeability sheet 2*a* is peeled off from the retaining sheet 9*b*, the penetrating magnetic materials 7*a* to 7*c* are unlikely to remain on the retaining sheet 9*b*, and the possibility is reduced that the penetrating magnetic materials 7*a* to 7*c* come off from the low-magnetic-permeability sheet 2*a*.

Figure 4:
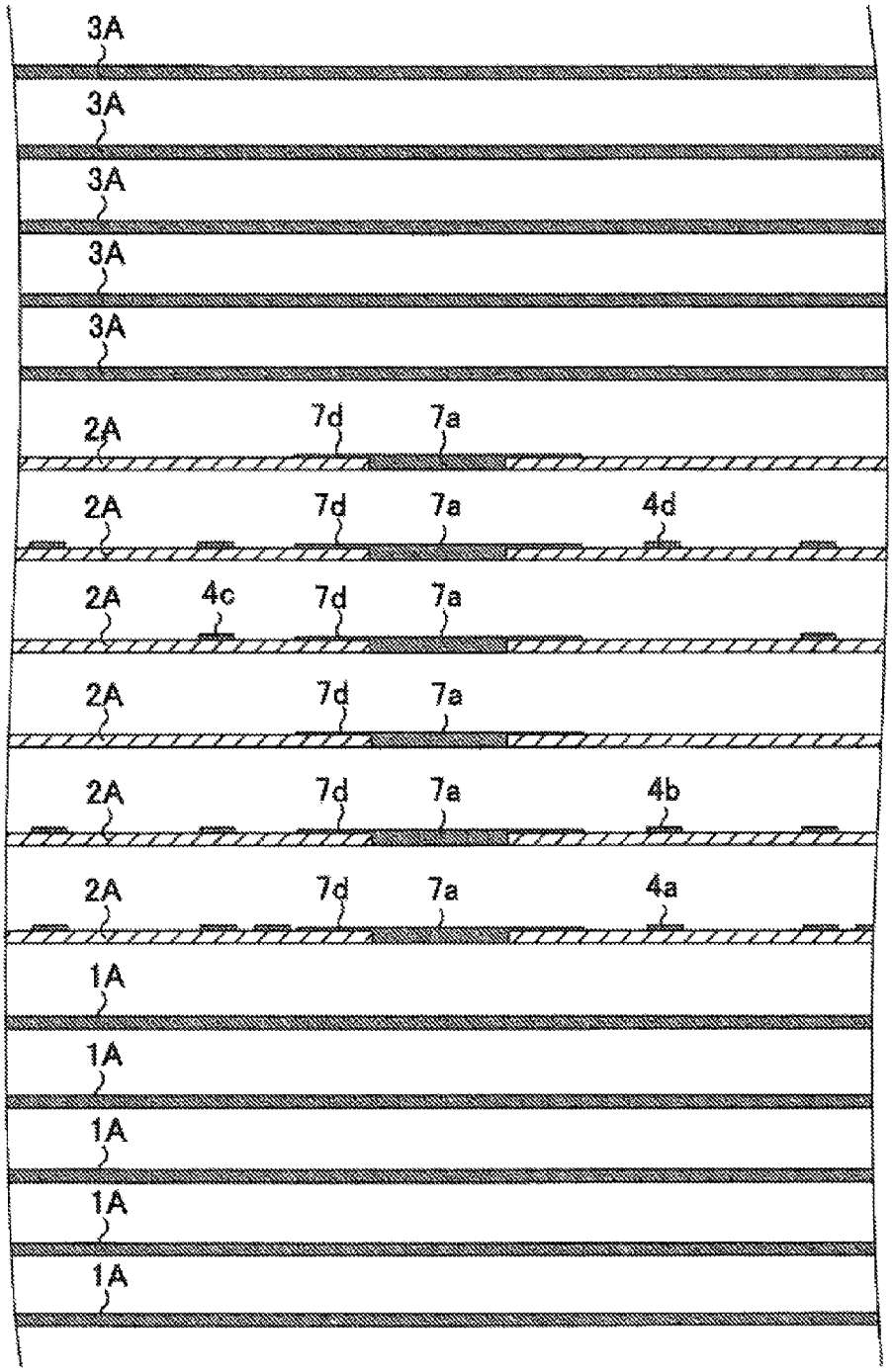
FIG. 4 is a cross-sectional view showing a process subsequent to FIG. 3C.

Next, as shown in FIG. 4, a plurality of the mother magnetic material sheets 1A, a plurality of the mother low-magnetic-permeability sheets 2A, and a plurality of the mother magnetic material sheets 3A are laminated.

Figure 5A:
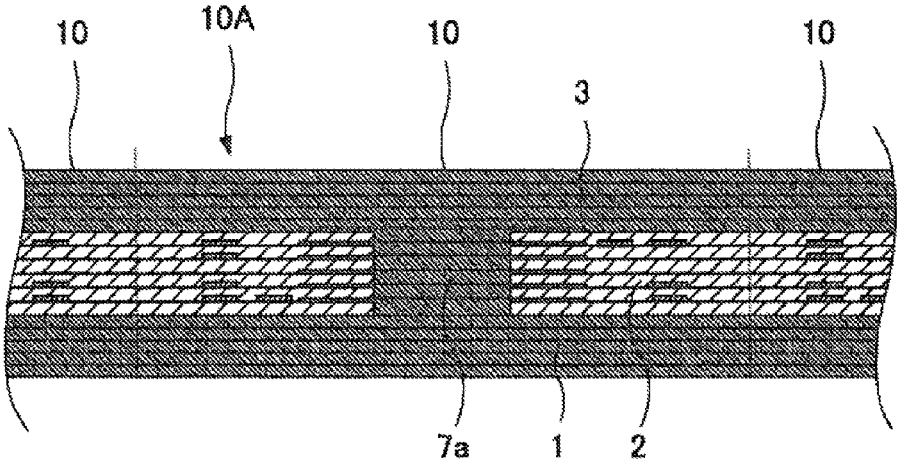
FIG. 5A is a cross-sectional view showing a process subsequent to FIG. 4.

Next, as shown in FIG. 5A, the laminated mother magnetic material sheets 1A, mother low-magnetic-permeability sheets 2A, and mother magnetic material sheets 3A are integrated by pressure bonding to form an unfired mother laminate 10A.

Next, although not shown, the unfired mother laminate 10A is fired at a predetermined profile to produce a fired mother laminate 10A.

Figure 5B:
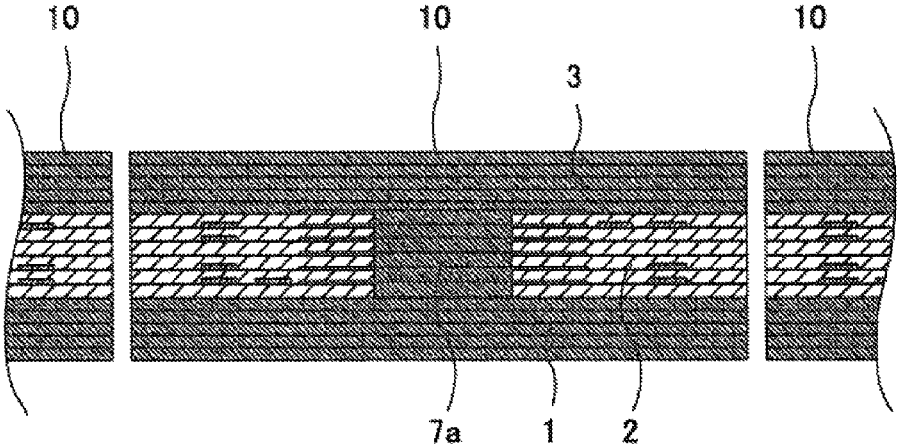
FIG. 5B is a cross-sectional view showing a process subsequent to FIG. 5A.

Next, as shown in FIG. 5B, the fired mother laminate 10A is divided into individual laminates 10. The division into the individual laminates may be conducted prior to the above firing.

At the end, although not shown, the external electrodes 6*a* to 6*d* are formed on the surface of each laminate 10 obtained by the division, to complete the common mode choke coil 100. The external electrodes 6*a* to 6*d* are formed, for example, by applying a conductive paste into a desired shape and firing the conductive paste.

The structure of the common mode choke coil 100 according to the exemplary embodiment and the example of the manufacturing method thereof has been described above. However, embodiments consistent with the present disclosure are not limited to the above contents, and various modifications can be made according to the principles of the present disclosure.

For example, the laminated electronic component is not limited to the common mode choke coil, and may be another type of a coil component or another type of an electronic component including a coil therein. In addition, the laminated electronic component is not limited to a component including two coils as in a common mode choke coil, and may be a component including a single coil or three or more coils.

In addition, the number of the columnar magnetic materials formed within the low-magnetic-permeability portion is not limited to three, and may be two or four or more.

Furthermore, the shape of the transverse section of each columnar magnetic material formed within the low-magnetic-permeability portion is not limited to a circular shape, and may be, for example, elliptical, rectangular, or other polygonal shape.

The inventors conducted the following experiment in order to confirm that the laminated electronic component according to the present disclosure has electrical properties equivalent to those of an existing one and that even when one of a plurality of the columnar magnetic material portions becomes non-penetrating, deterioration of the electrical properties is lower than when a columnar magnetic material portion of a laminated electronic component having only the single columnar magnetic material portion becomes non-penetrating.

As an example, the common mode choke coil 100 according to the exemplary embodiment described above was prepared. The diameter of each of the three columnar magnetic material portions of the common mode choke coil 100, namely, the laminate of the penetrating magnetic materials 7*a*, the laminate of the penetrating magnetic materials 7*b*, and the laminate of the penetrating magnetic materials 7*c*, was set to 0.065 mm.

In addition, as a comparative example, a common mode choke coil including one columnar magnetic material portion within a low-magnetic-permeability portion 2 was prepared. The transverse section of the columnar magnetic material portion was set to 0.12 mm×0.10 mm. Other than this, there is no difference between the example and the comparative example. More specifically, the configuration of the other portion is the same as that of the example, and the manufacturing method is also the same as that of the example.

The sum of the transverse sectional areas of the three columnar magnetic material portions of the example is 0.01 $mm^2$, the transverse sectional area of the columnar magnetic material portion of the comparative example is 0.012 $mm^2$, and both are substantially equal to each other.

The inventors measured a common-mode impedance (Ω) at 100 MHz with an impedance analyzer for the example and the comparative example. As a result, as shown in Table 1, the common-mode impedance was 160Ω in the example and 180Ω in the comparative example, and the electrical properties of both examples were substantially equal to each other.

TABLE 1

| | Common mode impedance (Ω) | | |
|---|---|---|---|
| | Penetrating magnetic path | Non-penetrating magnetic path | Change rate |
| Example | 160 | 130* | −19% |
| Comparative example | 180 | 85 | −53% |

*Case where one of three columnar magnetic material portions became non-penetrating.

Next, the inventors measured a common-mode impedance (Ω) at 100 MHz by simulation using an electromagnetic field simulator, when one of the three columnar magnetic material portions became non-penetrating in the example, and when the columnar magnetic material portion became non-penetrating in the comparative example.

As a result, as shown in Table 1, the common-mode impedance was 130Ω in the example and 85Ω in the comparative example. Whereas the change rate in the comparative example when the columnar magnetic material portion became non-penetrating was −53%, the change rate in the example when one of the columnar magnetic material portions became non-penetrating was −19%. Thus, it is recognized that the example has higher robustness when the columnar magnetic material portion becomes non-penetrating, than the comparative example.

What is claimed is:

1. A laminated electronic component comprising:

a first magnetic material portion;

a low-magnetic-permeability portion laminated on the first magnetic material portion, and including a plurality of laminated low-magnetic-permeability sheets;

a second magnetic material portion laminated on the low-magnetic-permeability portion;

at least one annular or spiral coil disposed within the low-magnetic-permeability portion;

a plurality of columnar magnetic material portions disposed within the low-magnetic-permeability portion so as to extend through inside of the coil and connect the first magnetic material portion to the second magnetic material portion, the plurality of columnar magnetic material portions each including a plurality of laminated penetrating magnetic materials, the penetrating magnetic materials each penetrating the corresponding low-magnetic-permeability sheets; and a plurality of film shaped magnetic material portions each configured to intervene between two penetrating magnetic materials adjacent in a lamination direction in which the plurality of penetrating magnetic materials are laminated, the plurality of film shaped magnetic material portions each being directly in contact with the two penetrating magnetic materials.

2. The laminated electronic component according to claim 1, wherein the coil includes a pair of coils which are electromagnetically coupled to each other to constitute a common mode choke coil.

3. The laminated electronic component according to claim 1, wherein each of the columnar magnetic material portions has a circular transverse section.

4. The laminated electronic component according to claim 2, wherein each of the columnar magnetic material portions has a circular transverse section.

5. A method of manufacturing the laminated electronic component of claim 1, the method comprising the steps of:

preparing a plurality of magnetic material sheets;

preparing a plurality of low-magnetic-permeability sheets;

forming, in the low-magnetic-permeability sheets, a plurality of holes extending through the low-magnetic-permeability sheets;

filling a magnetic material into the plurality of holes;

forming an annular or spiral coil conductor on a surface of a predetermined sheet among the plurality of low-magnetic-permeability sheets;

laminating a predetermined number of the magnetic material sheets to form a first magnetic material portion;

laminating the plurality of low-magnetic-permeability sheets in which the magnetic material has been filled into the holes and the coil conductor has been formed on the surface of the predetermined sheet, on the first magnetic material portion in a predetermined order to form a low-magnetic-permeability portion;

laminating a predetermined number of the magnetic material sheets on the low-magnetic-permeability portion to form a second magnetic material portion; and firing a laminate composed of the first magnetic material portion, the low-magnetic-permeability portion, and the second magnetic material portion.

6. The method according to claim 5, wherein the step of filling the magnetic material into the plurality of holes is conducted in a state where each low-magnetic-permeability sheet is attached to a retaining sheet, and the retaining sheet is peeled off from the low-magnetic-permeability sheet after the magnetic material is filled.

7. The method according to claim 6, wherein in peeling off the low-magnetic-permeability sheet from the retaining sheet, portions of the low-magnetic-permeability sheet where the plurality of holes into which the magnetic material has been filled are present are peeled off in order at different timings.

8. The method according to claim 5, wherein the plurality of holes are positioned on each low-magnetic-permeability sheet in an area surrounded by the annular or spiral coil conductor when viewed in a direction of the lamination.

* * * * *